US005599126A

United States Patent [19]

Hough

[11] Patent Number: 5,599,126

[45] Date of Patent: Feb. 4, 1997

[54] DISPOSABLE TOOTHBRUSH

[76] Inventor: Cheryl Hough, 285 Bastedo Court, Milton, Ontario, Canada, L9T 3P9

[21] Appl. No.: 554,618

[22] Filed: Nov. 6, 1995

Related U.S. Application Data

[63] Continuation of Ser. No. 201,954, Feb. 25, 1994, abandoned.

[51] Int. Cl.[6] ..... A46B 11/02

[52] U.S. Cl. ..... 401/184; 401/132; 401/268

[58] Field of Search ..... 401/184, 186, 401/268, 132

[56] References Cited

U.S. PATENT DOCUMENTS

| | | | |
|---|---|---|---|
| 776,468 | 11/1904 | Hosmer | 401/184 |
| 1,142,566 | 6/1915 | Jackson | 401/184 |
| 2,167,761 | 8/1939 | Levin et al. | 15/135 |
| 2,294,747 | 9/1942 | Habeck et al. | 300/21 |
| 2,550,190 | 4/1951 | Greenberg | 15/135 |
| 2,674,000 | 4/1954 | McDonald, Jr. et al. | 15/137 |
| 2,705,335 | 4/1955 | Glassman et al. | 15/136 |
| 2,750,614 | 6/1956 | Collins et al. | 15/131 |
| 2,813,290 | 11/1957 | Aschenbach | 401/184 |
| 3,165,776 | 1/1965 | Tuseth | 15/539 |
| 3,432,245 | 3/1969 | Hudson | 401/132 |
| 3,536,410 | 10/1970 | Wargoe | 401/268 X |
| 3,545,025 | 12/1970 | O'Connell | 15/104.94 |
| 3,589,823 | 6/1971 | Hendrickson | 401/176 |
| 3,738,762 | 6/1973 | Moore et al. | 401/186 |
| 3,891,085 | 6/1975 | Boger | 206/229 |
| 4,176,980 | 12/1979 | O'Neal et al. | 401/184 X |
| 4,265,560 | 5/1981 | Spica | 401/183 |
| 4,521,128 | 6/1985 | O'Neal | 401/183 |
| 4,522,524 | 6/1985 | Green | 401/183 |

FOREIGN PATENT DOCUMENTS

| | | | |
|---|---|---|---|
| 2639804 | 6/1990 | France | 401/268 |

*Primary Examiner*—Steven A. Bratlie

[57] ABSTRACT

A disposable toothbrush comprising an elongate handle having a fingergrip at one end and a bristle-carrying head adjacent the other end of the handle. The handle has an elongate shallow recess which extends from the fingergrip to the head and which contains toothpaste covered by a thin flexible membrane. The membrane defines a blister cover or a capsule. The head has a corresponding passage extending between the handle and an opening at the base of the bristles where the toothpaste will be extruded in use.

3 Claims, 2 Drawing Sheets

DISPOSABLE TOOTHBRUSH

CROSS-REFERENCE TO RELATED APPLICATION

This is a continuation of patent application Ser. No. 08/201,954, filed Feb. 25, 1994, abandoned.

FIELD OF THE INVENTION

This invention relates to a toothbrush having an integral supply of toothpaste sufficient for a single use of the toothbrush and intended to be disposed of after use.

BACKGROUND TO THE INVENTION

There exists a long-felt want for a disposable toothbrush, Patents dating back more than 50 years are a testament to this need. Unfortunately, toothbrushes designed for this purpose have usually been too awkward to use to have any significant mass-appeal. One prevalent problem occurring in prior art toothbrushes with self-contained dentifrice is that the supply of dentifrice is insufficient for distribution to the bristle area as in U.S. Pat. No. 3,432,245. Another problem is that the application of the dentifrice to the bristle area is perhaps too widespread and unhygienically messy as in U.S. Pat. No. 2,550,190 and in U.S. Pat. No. 3,165,776. In U.S. Pat. No. 4,522,524, the toothbrush handle defines a hollow container for receiving dentifrice and the handle is squeezed to extrude dentifrice into the bristle area. So that the handle can be held by the user during brushing, it must have a minimum rigidity and, accordingly, the handle will not remain in a collapsed condition after squeezing. Upon resumption of its original shape, some dentifrice may be sucked back into the handle because of the resulting vacuum. This problem is, in part, addressed in a second costlier embodiment in which a piston is moved along the length of the handle to extrude the dentifrice to the base of the bristle area.

It is an object of this invention to provide a disposable toothbrush which is convenient to use and which addresses at least some of the aforementioned problems.

SUMMARY OF THE INVENTION

In accordance with this invention, there is provided a disposable toothbrush comprising an elongate handle having a fingergrip at one end and a bristle-carrying head adjacent the other end of the handle. The handle has an elongate shallow recess which extends from the fingergrip to the head and which contains toothpaste covered by a thin flexible membrane. The head has a corresponding passage extending between the handle and an opening at the base of the bristles where the toothpaste will be extruded in use.

BRIEF DESCRIPTION OF THE DRAWINGS

In order that the invention may be more clearly understood, it is described below with reference to the accompanying drawings, in which.

DESCRIPTION OF THE INVENTION WITH REFERENCE TO DRAWINGS

Figure 1:
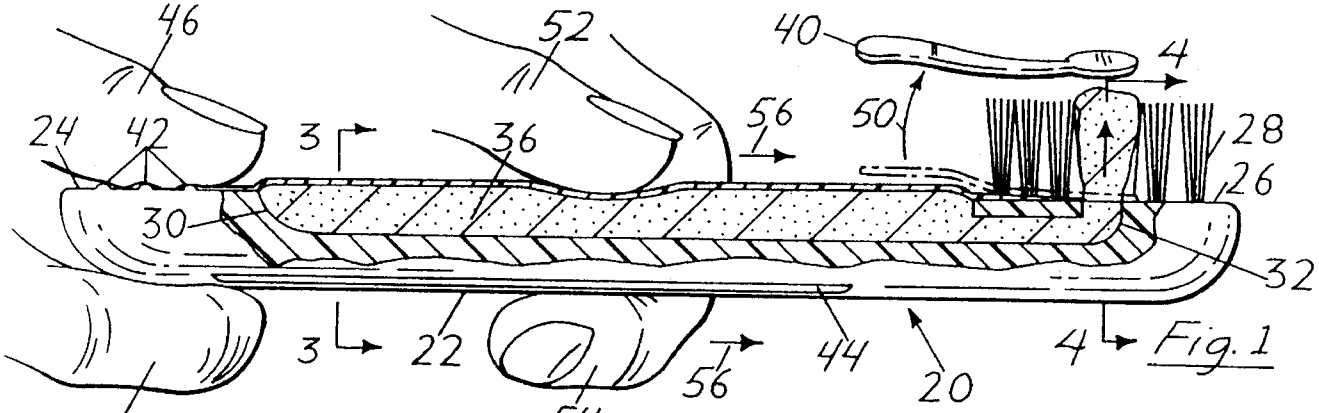
FIG. 1 is a partly-sectioned view of a first embodiment made according to the invention, in which toothpaste is covered by a thin flexible membrane defining a blister cover for a recess provided in a handle for the toothbrush.
Figure 2:
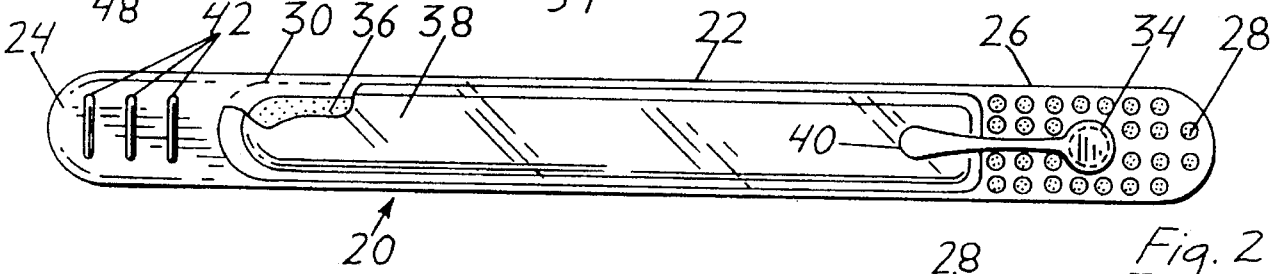
FIG. 2 is a top-plan view of FIG. 1.
Figure 4:
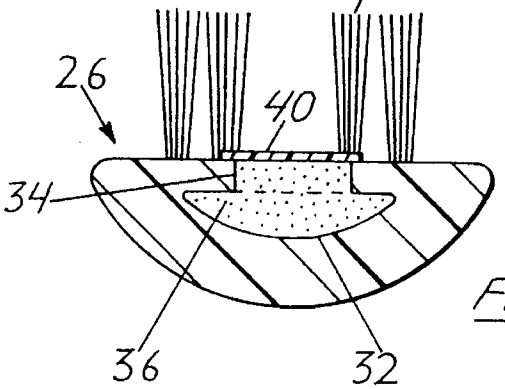
FIG. 4 is a cross-sectional view taken on line 4—4 of FIG. 1.
Figure 3:
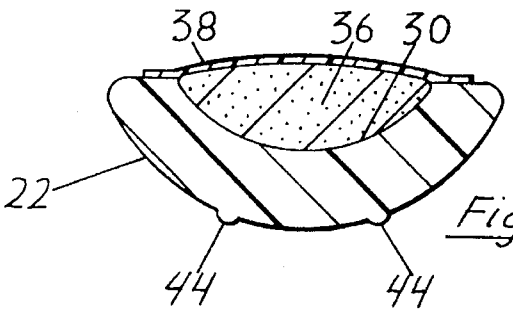
FIG. 3 is a cross-sectional view taken on line 3—3 of FIG. 1.
Figure 5:
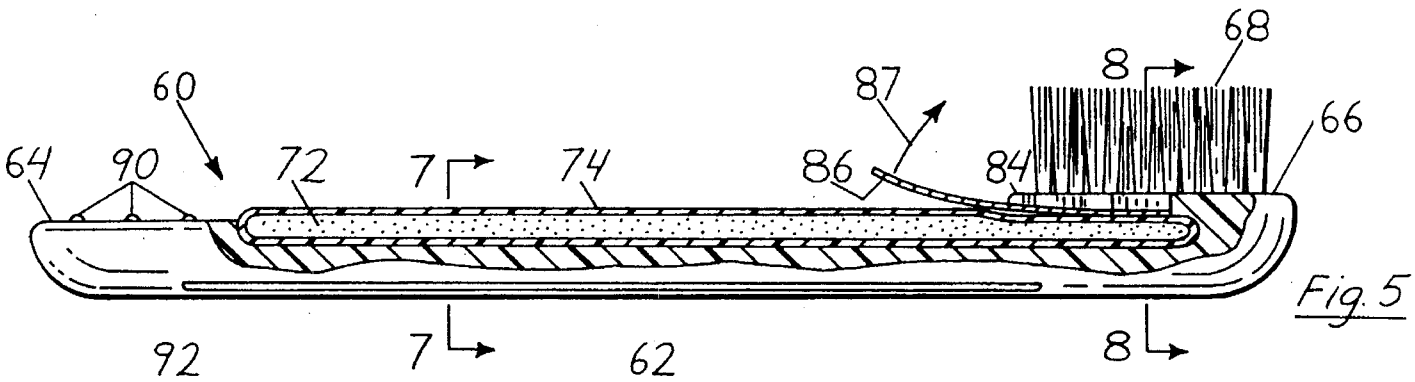
FIG. 5 is a partially-sectioned view of a second embodiment of the invention in which a thin flexible membrane defines a self-contained capsule for receiving toothpaste, the capsule being received in a recess provided in a handle for the toothbrush.
Figure 6:
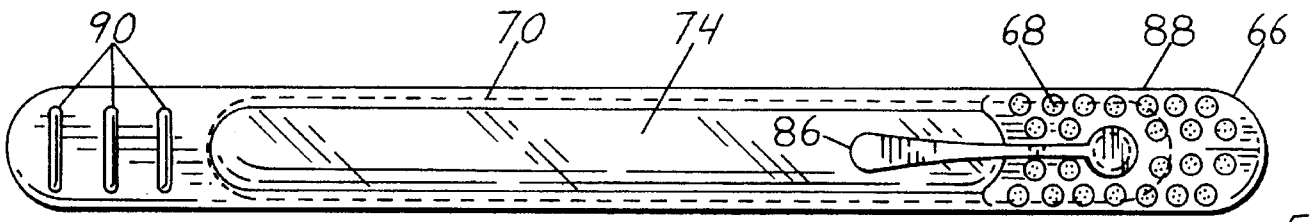
FIG. 6 is a top-plan view of FIG. 2.
Figure 8:
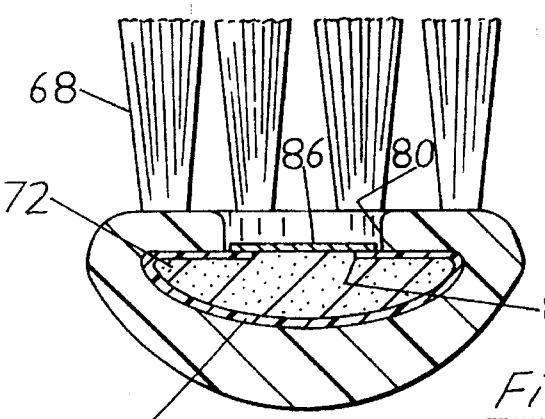
FIG. 8 is a cross-sectional view taken on line 8—8 of FIG. 5.

A first embodiment of a disposable toothbrush made in accordance with the invention is generally indicated by numeral 20 in FIG. 1 of the accompanying drawings. The toothbrush 20 has an elongate handle 22 with a fingergrip 24 at one end and a bristle-carrying head 26 adjacent to the other end of the handle. The bristles are provided in tufts extending upwardly (as drawn) and generally indicated by numeral 28. The handle has an elongate shallow recess 30 which extends substantially the entire length of the handle between the fingergrip 24 and the head 26. In the embodiment drawn, the recess 30 is open on the top-side of the handle 22, that is, on the same side as the bristles 28. The head 26 has a passage 32 which is L-shaped in section and is in fluid communication at one end with the recess 30 and at the other end terminates in an opening 34 (FIG. 2, 4) at the base of the bristles 28. A supply of toothpaste or dentifrice 36 is provided in the recess 30 which is hygienically sealed by a blister-cover 38 comprising a thin flexible membrane and selected from a suitable plastics material which may conveniently be bonded to the plastics material used to fabricate the handle 22. A removable pull-tab 40 covers the opening 34 in the head 26 so as to seal the toothpaste until the toothbrush is required.

The fingergrip 24 has transversely-extending ribs 42 and the handle 22 has longitudinally-extending ribs 44 on the bottom side opposite from the recess 30.

In use, the toothbrush is grasped with one hand between a thumb 46 and forefinger 48 with the thumb lying on the fingergrip 24.

The pull-tab 40 is removed as indicated by arrow 50 in FIG. 1 and the thumb 52 and forefinger 54 of the opposite hand glide along the blister cover 36 forwardly toward the head 26 as indicated by arrows 56, thereby extruding the toothpaste 38 through the opening 34.

In a second embodiment of the invention, drawn in FIGS. 5 to 8, the toothbrush is generally indicated by numeral 60. Similarly to the embodiment drawn in FIGS. 1 to 4, the toothbrush 60 comprises an elongate handle 62 having a fingergrip 64 at one end and a bristle-carrying head 66 adjacent the other end of the handle. The bristles are generally indicated by numeral 68.

Figure 7:
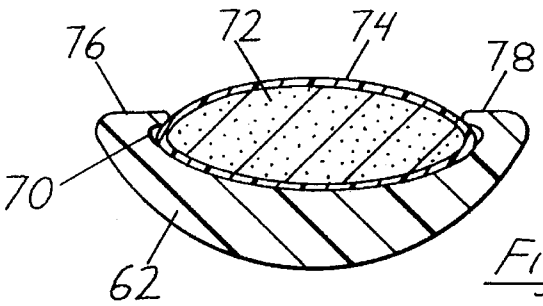
FIG. 7 is a cross-sectional view taken on line 7—7 of FIG. 5.

An elongate shallow recess 70 formed in the handle 62 receives toothpaste 72 provided in a capsule 74 made from a thin flexible membrane. The capsule 74 is retained in the recess 70 by a pair of oppositely-disposed lips 76, 78 formed in the handle 62 and extending along the length of the recess 70 (FIG. 7).

A passage 80 formed in the head 66 is in fluid communication with the recess 70 and terminates in an opening 82 at the base of the bristles 68. The opening 82 forms part of a key-hole slot 84 formed in the head 66 and separates the bristles to provide access to a pull-tab 86. The pull-tab 86 covers an orifice 88 provided at one end of the capsule 74. It will be appreciated that the pull-tab 86 seals the toothpaste 72 within the capsule 74.

The toothbrush 60 also includes transverse ribs 90 on the upper surface of the fingergrip 64 and longitudinally-extending ribs 92 on the bottom surface of the handle 62 to facilitate grasping of the toothbrush at one end and gliding the other hand forwardly toward the bristle area with the other hand, respectively.

In use, the toothbrush 60 is grasped at one end in the fingergrip area 64, the pull-tab 86 is removed, as indicated by arrow 87, and the toothpaste 72 is extruded towards the head 66 by gliding fingers forwardly along the exposed surface of the capsule 74.

It will be appreciated that the membrane comprising the capsule 74 or the blister cover 38 is sufficiently thin and flexible that it will remain in a collapsed configuration and not resume its original shape. Accordingly, no vacuum is created to aspire any dentifrice away from the bristle area. Furthermore, the length of the recess is predetermined to accommodate a sufficient quantity of toothpaste for delivery to the bristle area and for average consumption by a user.

Several variations may be made to the above-described embodiments of the invention without departure from the appended claims. In particular, it will be appreciated that the toothbrush may comprise a head portion which is separable from the handle portion and will, accordingly, include additional means for securing the head to the handle.

I claim:

1. In a disposable toothbrush for single use comprising an elongate handle having a fingergrip at one end and a bristle-carrying head adjacent the other end of the handle, a plurality of bristles extending transversely to the handle from a base for the bristles defined by the head on a top side of the toothbrush, the improvement in which the handle has an elongate shallow recess formed therein which extends along the length of the handle from the fingergrip to the head, and is adapted to receive a predetermined volume of a selected toothpaste sufficient for a single application of toothpaste to the head, the recess being covered by a thin flexible membrane, and opening onto one side of the handle for access to said membrane, the head has a passage in fluid communication with the recess which extends from the handle to a single opening formed in the head at the base for the bristles, a removable pull tab being disposed adjacent the said opening in the head and adapted to seal any toothpaste in the head, so that upon removal of the pull tab, any toothpaste contained by the membrane in the recess may be extruded through the opening in the head to the bristles, the fingergrip has transversely extending ribs and the handle has longitudinally extending ribs on a side of the handle opposite from the recess whereby the fingergrip at one end of the handle may be held by one hand without deflection of the membrane into the recess and the toothpaste may be extruded from the recess to the bristles by gliding the other hand, guided by said longitudinally extending ribs, over the membrane surface along the recess from the fingergrip toward the head and into the bristles.

2. In a disposable toothbrush for single use comprising an elongate handle having a fingergrip at one end and a bristle-carrying head adjacent the other end of the handle, a plurality of bristles extending transversely to the handle from a base for the bristles defined by the head on a top side of the toothbrush, the improvement in which the handle has an elongate shallow recess formed therein which extends along the length of the handle from the fingergrip to the head, and is adapted to receive a predetermined volume of a selected toothpaste sufficient for a single application of toothpaste to the head, the recess being covered by a thin flexible membrane defining a self-contained capsule for receiving the toothpaste, the capsule having an orifice covered by a removable pull tab, and the recess opening onto one side of the handle for access to said capsule for extrusion of the toothpaste to the bristle-carrying head, and the head is hollow to be in fluid communication with the recess in the handle and to receive an end of the capsule having said orifice, the base for the bristles in the head having a key-hole slot to provide access to the pull tab, so that upon removal of the pull tab, any toothpaste contained by the capsule in the recess may be extruded by gliding one hand over the membrane surface of the capsule along the recess from the fingergrip toward the head and into the bristles.

3. In a disposable toothbrush for single use comprising an elongate handle having a fingergrip at one end and a bristle-carrying head adjacent the other end of the handle, a plurality of bristles extending transversely to the handle from a base for the bristles defined by the head on a top side of the toothbrush, the improvement in which the handle has an elongate shallow recess formed therein which extends along the length of the handle from the fingergrip to the head, and is adapted to receive a predetermined volume of a selected toothpaste sufficient for a single application of toothpaste to the head, the recess being covered by a thin flexible membrane defining a self-contained capsule for receiving the toothpaste, the capsule having an orifice covered by a removable pull tab, and the recess opening onto one side of the handle for access to said capsule for extrusion of the toothpaste to the bristle-carrying head, the head is hollow to be in fluid communication in the handle and to receive an end of the capsule having said orifice, the base for the bristles in the head having a key-hole slot to provide access to the pull tab, so that upon removal of the pull tab, any toothpaste contained by the capsule in the recess may be extruded, the fingergrip has transversely extending ribs and the handle has longitudinally extending ribs on a side of the handle opposite from the recess whereby the fingergrip at one end of the handle may be held by one hand without deflection of the membrane into the recess and the toothpaste may be extruded from the recess to the bristles by gliding the other hand, guided by said longitudinally extending ribs, over the membrane surface of the capsule along the recess from the fingergrip toward the head and into the bristles.

* * * * *